US010354812B1

(12) United States Patent
Enger et al.

(10) Patent No.: US 10,354,812 B1
(45) Date of Patent: Jul. 16, 2019

(54) CIRCUIT BREAKER LOCKOUT DEVICE

(71) Applicant: Brady Worldwide, Inc., Milwaukee, WI (US)

(72) Inventors: Andrew N. Enger, Muskego, WI (US); Sohail Anwar, New Berlin, WI (US)

(73) Assignee: Brady Worldwide, Inc., Milwaukee, WI (US)

( * ) Notice: Subject to any disclaimer, the term of this patent is extended or adjusted under 35 U.S.C. 154(b) by 0 days.

(21) Appl. No.: 15/873,822

(22) Filed: Jan. 17, 2018

(51) Int. Cl.
*H01H 9/28* (2006.01)

(52) U.S. Cl.
CPC ..... *H01H 9/283* (2013.01)

(58) Field of Classification Search
CPC ..... H01H 9/287; H01H 9/286; H01H 9/28
USPC ..... 200/43.14
See application file for complete search history.

(56) References Cited

U.S. PATENT DOCUMENTS 5,300,740 A * 4/1994 Benda ..... H01H 9/283 200/43.14
5,543,593 A * 8/1996 Turek ..... H01H 9/282 200/43.11
6,649,851 B1 * 11/2003 Hennel ..... H01H 9/283 200/43.13
6,703,572 B1 * 3/2004 Broghammer ..... H01H 9/282 200/43.11
7,501,593 B2 * 3/2009 Brojanac ..... H01H 9/283 200/43.14
8,629,359 B2 * 1/2014 Hackett ..... H01H 9/283 200/43.14
9,202,646 B2 * 12/2015 Obenshain ..... H01H 9/20
9,208,964 B2 * 12/2015 Dudgeon ..... H01H 9/283
2004/0040824 A1 3/2004 Benda
2006/0266631 A1 11/2006 Kalous et al.
2014/0102865 A1 4/2014 Obenshain et al.
2014/0165384 A1 6/2014 Dudgeon et al.
2016/0336122 A1 11/2016 Benda et al.

OTHER PUBLICATIONS

Brady, Brady Part: 51254; EZ Paneloc Clamp-On Breaker Lockouts; https://www.bradyid.com/en-us/product/51254, Admitted Prior Art, 5 pages.
PCT International Search Report and Written Opinion, PCT/US2018/064208, dated Feb. 26, 2019, 14 pages.

* cited by examiner

*Primary Examiner* — Kyung S Lee
(74) *Attorney, Agent, or Firm* — Quarles & Brady LLP

(57) ABSTRACT

A lockout device for securing a circuit breaker switch is provided. The lockout device comprises an outer housing having side walls extending away from a base wall formed on one axial end of the outer housing to define a cavity. An arm is received within a portion of the outer housing. The arm received within a portion of the housing, the arm having a hook section and an engaging section positioned apart from one another to receive the circuit breaker switch therein. A spring is positioned between the base wall and the arm and biases the outer housing axially relative to the arm. A screw extends through the engaging section of the arm toward the hook, and is movable between the engaging section and the hook.

20 Claims, 7 Drawing Sheets

CIRCUIT BREAKER LOCKOUT DEVICE

CROSS-REFERENCE TO RELATED APPLICATIONS

Not Applicable.

STATEMENT REGARDING FEDERALLY SPONSORED RESEARCH

Not Applicable.

BACKGROUND

The present disclosure relates generally to a circuit breaker lockout device. In particular, this disclosure relates to an apparatus that can be secured to a circuit breaker to selectively prevent movement of the circuit breaker switch between an open and a closed position.

Circuit breakers are electrical switches designed to protect electrical circuits from damage caused by current overload or short circuiting. Although circuit breakers are typically used to detect fault conditions and automatically open the circuit experiencing the fault condition, circuit breakers can also be used as manual energy isolation devices. The circuit breaker can be manually placed in an OFF position, which prevents current from passing through the circuit. When current cannot pass through the circuit, accidental startup of equipment is avoided, which could otherwise potentially endanger an employee.

In an effort to promote workplace safety, OSHA has mandated that all energy sources be turned off and locked during maintenance and repair. When a piece of equipment is being serviced or repaired, the equipment's associated circuit breaker must be secured and locked in an open position. Tagout procedures can also be used to provide an indication as to which worker has locked out the circuit breaker to perform service.

While most circuit breakers function similarly, circuit breakers produced by different manufacturers can have different shapes and sizes. Due to the different physical shape of each circuit breaker, many different lockout devices may be needed within the same workplace. Locating the proper device for each circuit breaker can be time-intensive, resulting in lost time and efficiency. Workers may be tempted to use an improper lockout device on a circuit breaker, which may be less effective at locking the circuit breaker in an open position.

BRIEF SUMMARY

The present disclosure provides a circuit breaker lockout device that can be quickly and easily coupled to a variety of differently-sized circuit breakers. The circuit breaker lockout device can be secured to a circuit breaker and locked out in accordance with OSHA regulations using a variety of different lock types and sizes. When secured to a circuit breaker and properly locked out using the shackle (or other component) of a lock, the switch of the circuit breaker cannot be freely rotated and the circuit breaker lockout device cannot be readily removed from the circuit breaker without first removing the lock from the circuit breaker lockout device. A biasing element within the circuit breaker lockout device selectively allows rotational movement of a fastener used to couple the circuit breaker lockout device to the circuit breaker. The biasing element allows the circuit breaker lockout device to quickly transition between a closed position (where the circuit breaker lockout device is securely coupled to a circuit breaker) and an open position (and vice versa) that allows the circuit breaker lockout device to be readily uncoupled from a circuit breaker by hand. Using the disclosed circuit breaker lockout device, warehouse or factory efficiency can be greatly improved.

In one aspect, the present disclosure provides a lockout device for securing a circuit breaker switch. The lockout device comprises an outer housing, an arm, a spring, and a screw. The outer housing has side walls extending away from a base wall formed on one axial end of the outer housing to define a cavity, and the arm is received within a portion of the cavity. The arm has a hook section and an engaging section positioned apart from one another to receive the circuit breaker switch therein. The spring is positioned between the base wall and the arm. The spring biases the outer housing axially relative to the arm. The screw extends through the engaging section of the arm toward the hook section, and is movable between the engaging section and the hook section.

In another aspect, the present disclosure provides a lockout device for securing a circuit breaker switch. The lockout device comprises an outer housing, and arm, and a screw. The outer housing has a base wall on one axial end thereof and side walls extending away from the base wall to collectively define a cavity. The base wall has a channel formed therethrough. The arm is received within a portion of the cavity, and has an engaging section and a hook section that define a switch receiving recess. The arm also has a tab axially extending through the channel formed in the base wall. The screw extends through the engaging section of the arm toward the hook section, and is threadably adjustable axially toward the hook section to engage the circuit breaker switch.

In another aspect, the circuit breaker lockout device includes an arm and a fastener extending through the arm that together engage and secure the lockout device to a circuit breaker. The arm is partially received within an outer housing, which is movable relative to the arm between an open position and a closed position. A biasing element is positioned between the arm and the outer housing, and allows the outer housing to be resiliently displaced relative to the arm to a closed position, where a locking aperture formed through the arm is exposed from the outer housing. When exposed from the outer housing, a lock shackle can be passed through the locking aperture to prevent the outer housing from returning to its resting, open position relative to the arm. When a lock shackle is passed through the locking aperture, a head of the fastener is at least partially received within the walls of the outer housing, which together prevent rotation of the fastener that could unsecure the circuit breaker lockout device from the circuit breaker. Once the lock shackle is removed, the biasing element urges the outer housing back to an open position, exposing the head of the fastener from the outer housing. Once exposed from the outer housing, the head of the fastener can be rotated to uncouple the circuit breaker lockout device from the circuit breaker.

The foregoing and other aspects and advantages of the disclosure will appear from the following description. In the description, reference is made to the accompanying drawings which form a part hereof, and in which there is shown by way of illustration a preferred configuration of the disclosure. Such configuration does not necessarily represent the full scope of the disclosure, however, and reference is made therefore to the claims and herein for interpreting the scope of the disclosure.

BRIEF DESCRIPTION OF DRAWINGS

The invention will be better understood and features, aspects and advantages other than those set forth above will become apparent when consideration is given to the following detailed description thereof. Such detailed description makes reference to the following drawings.

Figure 1:
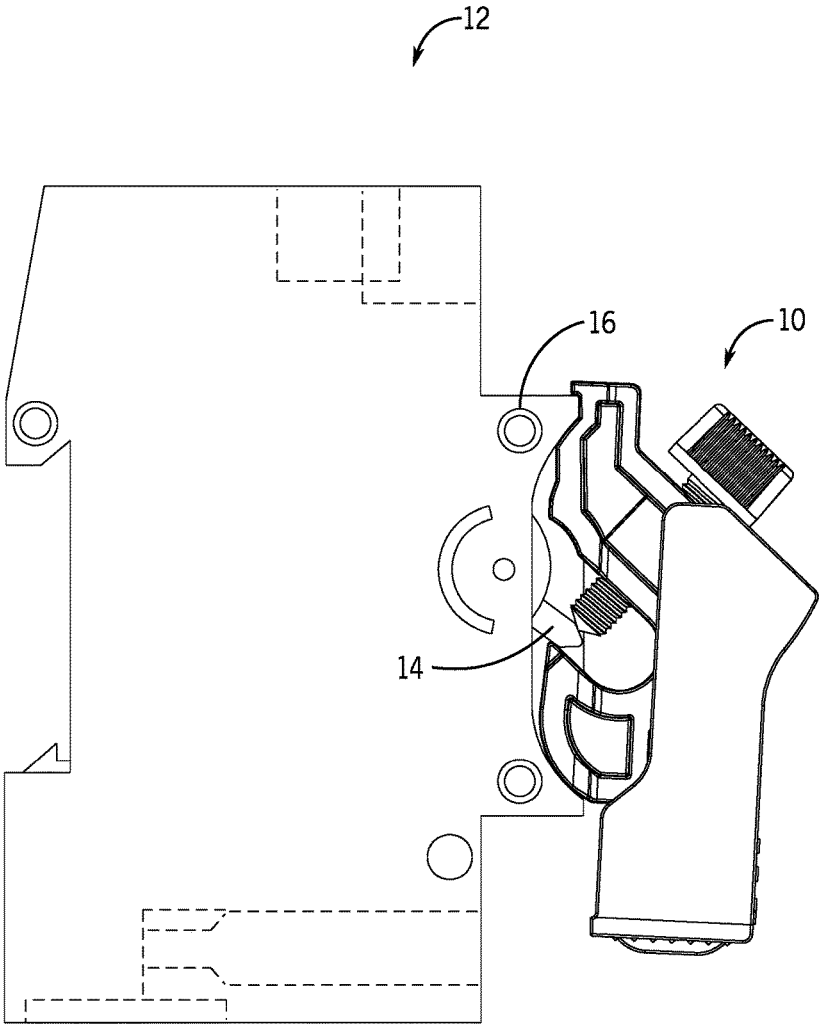
FIG. 1 illustrates a circuit breaker lockout device attached to, but not yet fully locking out, a circuit breaker.

Corresponding reference characters indicate corresponding parts throughout the several views. Although the drawings represent embodiments of the present disclosure, the drawings are not necessarily to scale and certain features may be exaggerated in order to better illustrate and explain the embodiments of the present disclosure.

DETAILED DESCRIPTION

Generally, the present disclosure provides devices and methods for locking out a circuit breaker. When installed, the lockout devices can be secured to the circuit breaker switch and can engage the circuit breaker body to prevent rotation of the circuit breaker switch relative to the circuit breaker body.

For purposes of clarity, the foregoing figures will be described using terms such as "rear," "back," "front," "top," "bottom," "right," "left," "side," "downward," "upward," or other types of directional language. The directional language used in the specification should not be considered limiting, as it is provided for descriptive purposes only. It should be understood that these terms are used within the specification only to promote understanding of the disclosure and refer only to the orientation of components shown in the provided figures. As will be appreciated by one of ordinary skill in the art, the lockout devices provided in the disclosure can be oriented in multiple orientations and directions and still remain effective at locking out circuit breakers. For example, while the lockout device 10 is shown in FIG. 1 coupled to an upright circuit breaker 12, it should be understood that this lockout device 10 is similarly adapted to be coupled to horizontally-oriented circuit breakers, and would only need to be rotated to do so.

Figure 6:
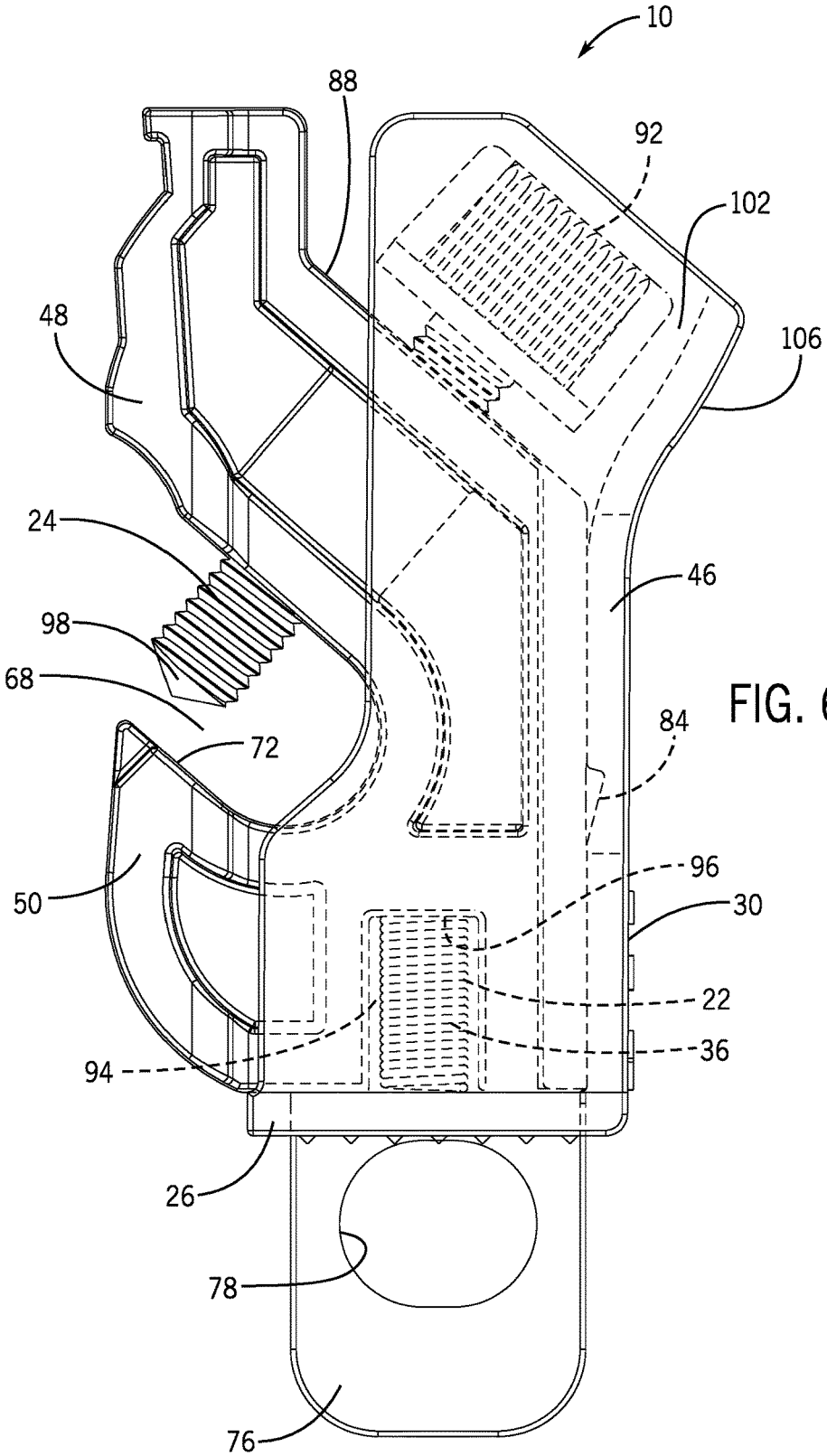
FIG. 6 is a side view of the circuit breaker lockout device shown in FIG. 1 shown in a "closed" or "locked" configuration.

FIG. 1 illustrates a lockout device 10 according to an embodiment of the disclosure. The lockout device 10 can be coupled to a circuit breaker 12 by engaging the switch 14 and the body 16 of the circuit breaker 12, which prevents the switch 14 from rotating relative to the body 16 to close the circuit breaker 12. Once the lockout device 10 is coupled to the switch 14 and body 16 of the circuit breaker 12, the lockout device 10 can be transitioned from an open position (as illustrated in FIG. 1) to a closed position (as illustrated in FIG. 6), where it can be locked into position using various types of locking devices. With the circuit breaker switch 14 locked into place and the lockout device 10 in the closed position, equipment (not shown) on the corresponding circuit can be serviced or repaired in accordance with OSHA standards and regulations.

Figure 2:
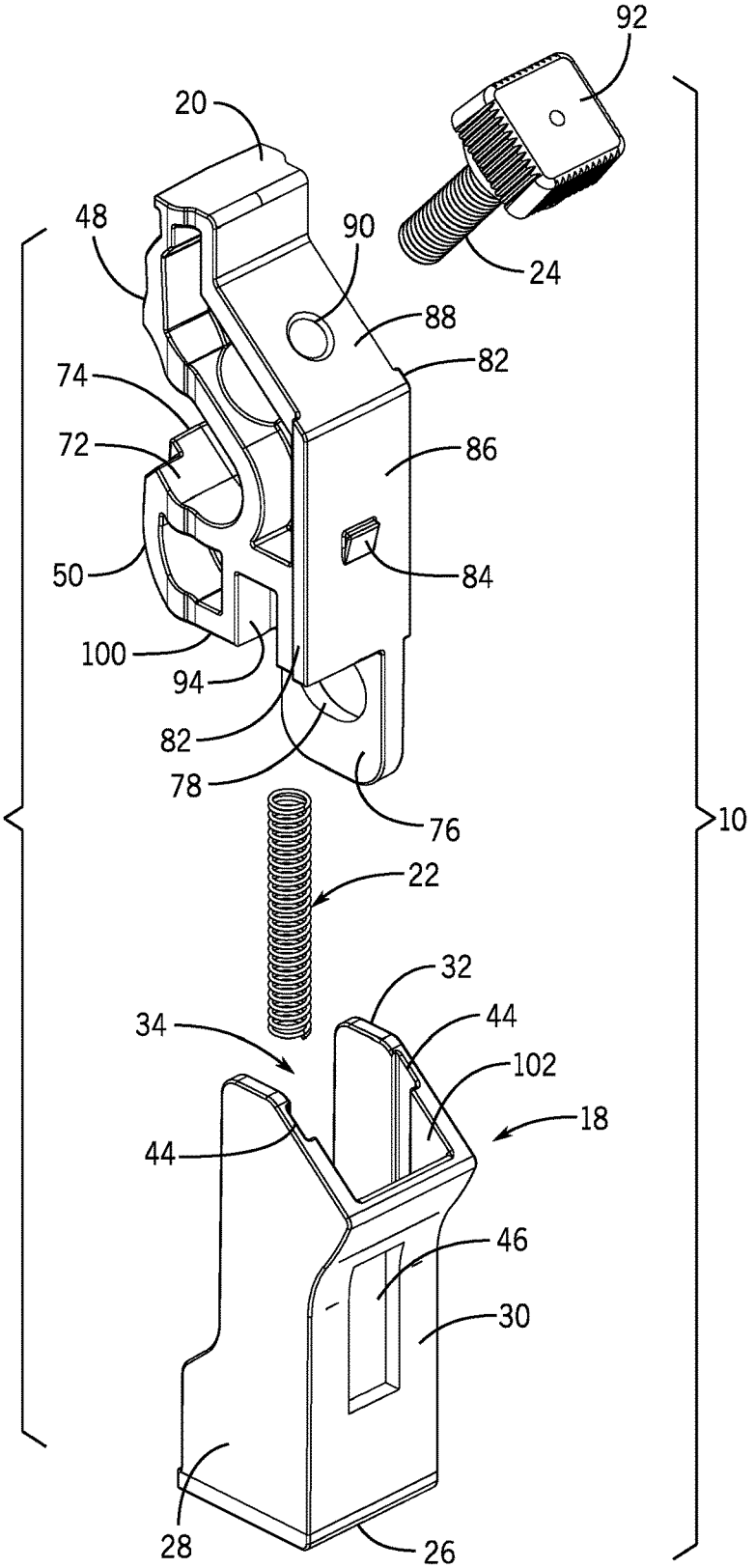
FIG. 2 is an exploded view of the circuit breaker lockout device of FIG. 1.

As shown in FIG. 2, the lockout device 10 includes an outer housing 18 and an arm 20 received within the outer housing 18. A biasing element 22 can be interposed there between and received within the outer housing 18 to bias the arm 20 away from the outer housing 18 to urge the outer housing 18 to translate axially relative to the arm 20 to an open position (shown in FIG. 5) from a closed position (shown in FIG. 6). The biasing element 22 can be a compression spring or a resilient member formed of elastomeric material, for example. A fastener 24, such as a screw, can be received in and extend through a portion of the arm 20. In some embodiments, the fastener 24 extends through the arm 20 to compressively engage a circuit breaker switch 14.

Figure 3A:
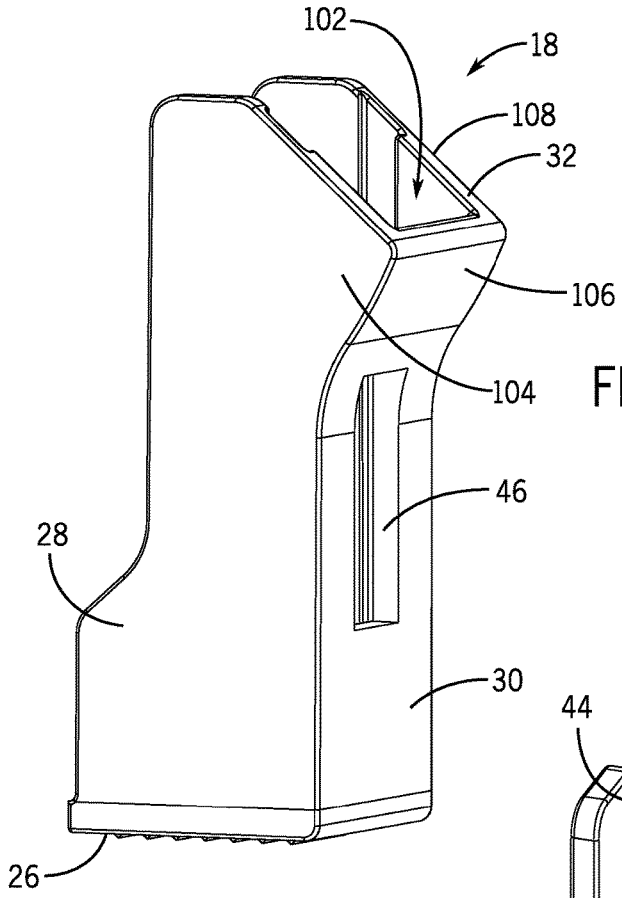
FIG. 3A is a rear perspective view of an outer housing used to form the circuit breaker lockout device of FIG. 1.
Figure 3B:
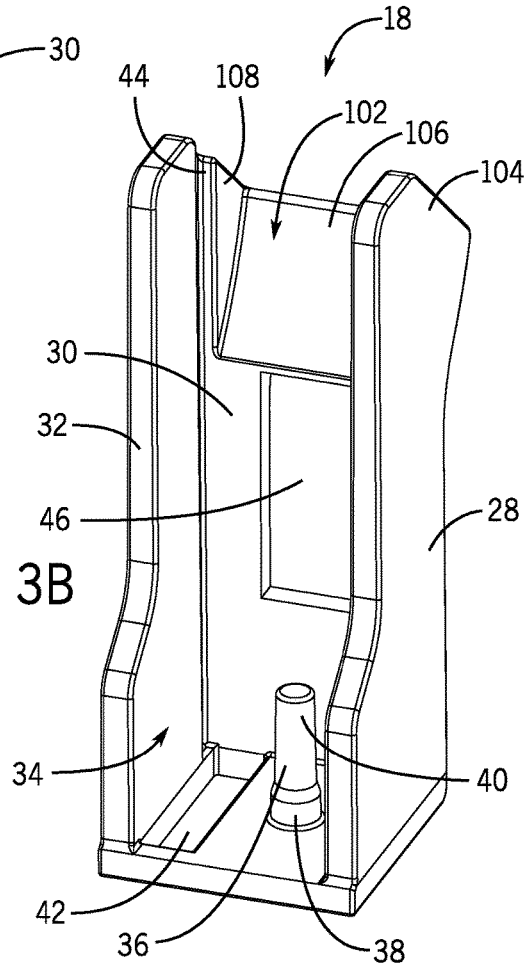
FIG. 3B is a top perspective view of the outer housing of FIG. 3A.

With further reference to FIGS. 3A and 3B, the outer housing 18 is illustrated. The outer housing 18 has a base wall 26 formed on one axial end of the outer housing 18. Side walls 28, 30, 32, can extend away from the base wall 26 to define a cavity 34 within the outer housing 18, which can receive a portion of the arm 20. In some embodiments, the base wall 26 has a rectangular shape. The side walls 28, 30, 32 can extend perpendicularly away from the base wall 26 to form a 3-sided box-like shape having a right side wall 28, a rear wall 30, and a left side wall 32. The outer housing 18 can be formed of a generally rigid material, such as acrylonitrile butadiene styrene (ABS), for example. In some embodiments, the outer housing 18 is formed of a molded composite material, such as fiberglass reinforced nylon.

In the illustrated form, a support structure 36 extends upwardly away from the base wall 26 to support the biasing element 22. The support structure 36 is integrally formed with the base wall 26, and extends perpendicularly away from the base wall 26. In some embodiments, the support structure 36 has a substantially cylindrical shape that is received within the biasing element 22 (e.g., a central channel of a compression spring). The support structure 36 can be formed of a first section 38 formed nearest the base wall 26 and a second section 40 extending away from the first section 38. In some embodiments, the first section 38 is defined by a radius larger than the radius defining the second section 40. The first section 38 can closely match or form an interference fit with the biasing element 22 to anchor the biasing element 22 to the outer housing 18, while the second section 40 can guide the motion of the biasing element 22.

One or more guides or bearing surfaces can be formed within the housing 18 to allow and constrain relative motion between the outer housing 18 and the arm 20. In some embodiments, a channel 42 is formed through the base wall 26. The channel 42 can receive a portion of the arm 20 (e.g., the tab 76, shown in FIGS. 4A-4C) to allow the outer housing 18 to move axially relative to the arm 20, between open and closed positions. In some embodiments, the channel 42 is offset to one side of the base wall 26 and has a rectangular shape. Additionally, one or more slots 44 can be formed in the side walls 28, 32 to axially guide the arm 20 within the outer housing 18. The slots 44 can have a U-shaped cross-section that extends vertically away from the base wall 26 to define a pathway for the arm 20 within the outer housing 18. In some embodiments, the slots 44 extend the entire axial length of the side walls 28, 32 that the slots 44 are formed in. A window 46 can also be formed through one side wall 28, 30, 32 to secure the arm 20 within the outer housing 18. In some embodiments, the window 46 is formed through the rear wall 30, and can be positioned away from the base wall 26. The outer perimeter of the window 46 can have a rectangular shape to constrain axial movement between the arm 20 and the outer housing 18, as explained in more detail below.

Figure 4A:
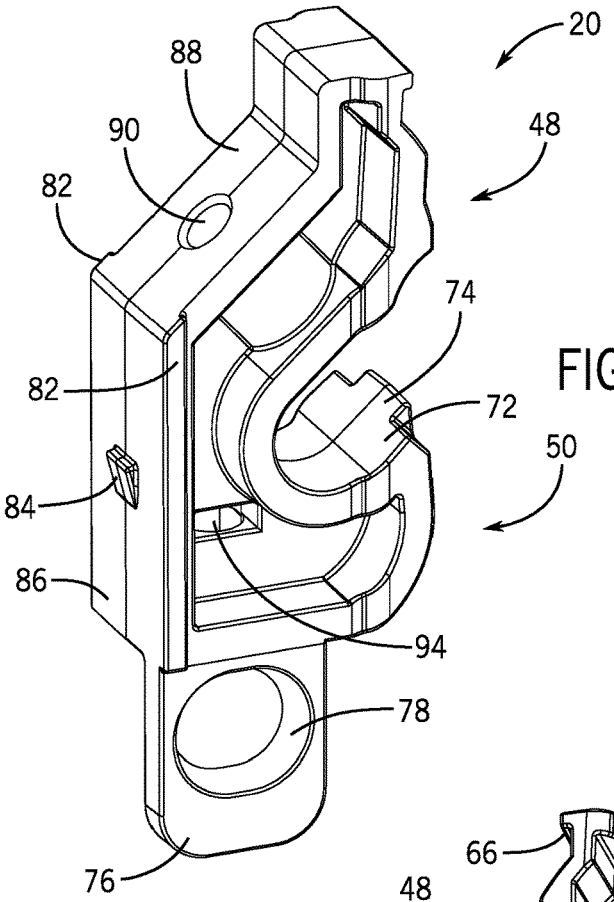
FIG. 4A is a top, rear perspective view of an arm of the circuit breaker lockout device of FIG. 1.
Figure 4B:
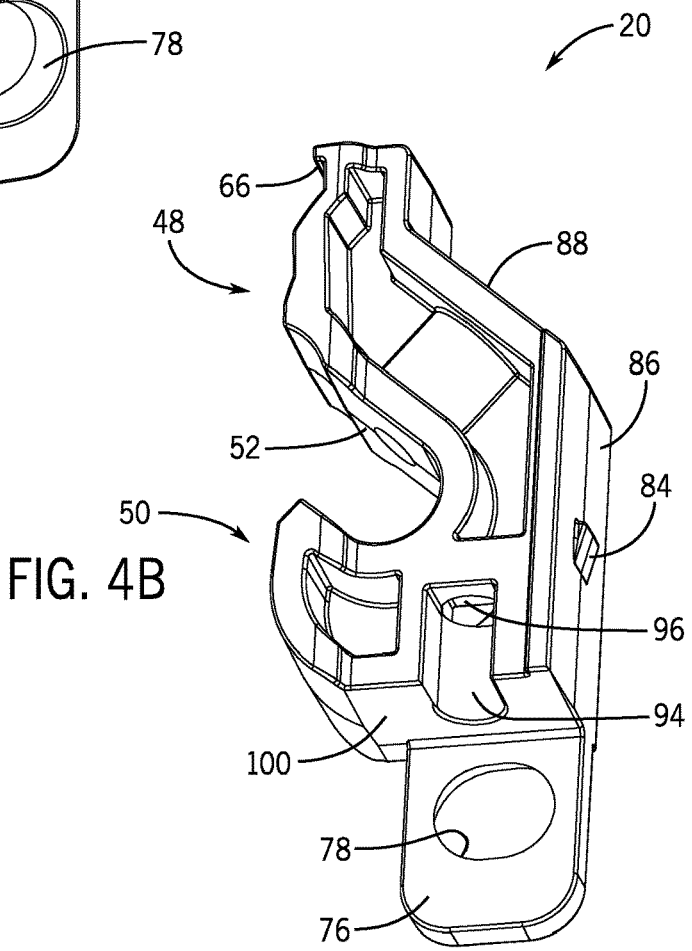
FIG. 4B is a bottom, rear perspective view of the arm of FIG. 4A.
Figure 4C:
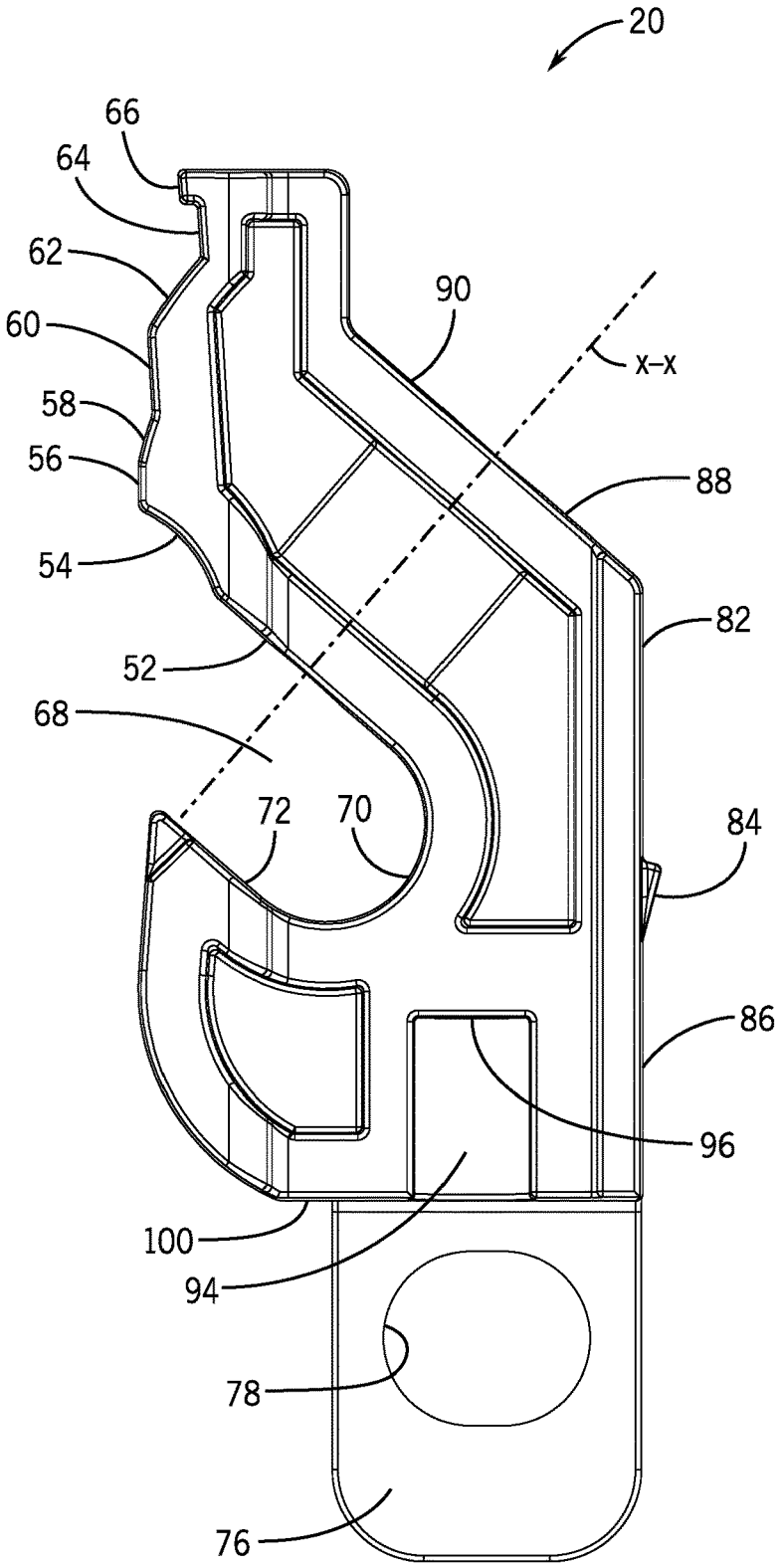
FIG. 4C is a side view of the arm of FIG. 4A.

With further reference to FIGS. 4A-4C, the arm 20 is illustrated. The arm 20 is conceptually split into an engaging section 48 and a hook section 50 that are configured to engage the circuit breaker body 16 and switch 14 respectively. The engaging section 48 can have a profile that allows flat, compressive engagement with several different types of circuit breakers 12. In some embodiments, the engaging section 48 includes an angled surface 52 (see FIG. 4C) extending tangentially away from the hook section 50. The angled surface 52 extends toward a concave surface 54, which extends upwardly and outwardly away from the angled surface 52. A leading surface 56 extends upwardly and inwardly from the concave surface 54, toward a first inwardly angled surface 58. A first outwardly angled surface 60 extends upwardly from the first inwardly angled surface 58 toward a second inwardly angled surface 62. In some embodiments, the first inwardly angled surface 58 and the second inwardly angled surface 62 each have a slightly convex shape. A second outwardly angled surface 64 extends upwardly and outwardly away from the second inwardly angled surface 62, toward a mounting lip 66, which extends outwardly away from the second outwardly angled surface 64. Each of these surfaces can allow the arm 20 (and the lockout device 10) to form secure contact with the body 16 of several different types, shapes, and sizes of circuit breaker 12. In some embodiments, the arm 20 can be formed of a polymeric or composite compound, such as fiberglass reinforced nylon.

The engaging section 48 extends toward the hook section 50 to define a switch receiving recess 68. In some embodiments, the switch receiving recess 68 is defined by the angled surface 52, a bend 70 extending away from the angled surface 52, and a switch engaging surface 72 of the hook section 50. The switch engaging surface 72 can extend approximately parallel to the angled surface 52 and can be a substantially flat surface. In some embodiments, a distal end of the switch engaging surface 72 includes a tooth 74.

Similar to the outer housing 18, the arm 20 can include guide features to define and permit relative motion between the outer housing 18 and the arm 20, with such guide features interacting with the guides in the outer housing 18. In some embodiments, a tab 76 forms one end of the arm 20. The tab 76 can extend axially away from the hook section 50, and may be offset to one side of the arm 20. When the arm 20 is received into the outer housing 18, the tab 76 can extend into and/or through the channel 42 formed in the base wall 26 of the outer housing 18. The tab 76 can form a clearance fit with the channel 42, which can constrain the allowable relative motion between the arm 20 and the outer housing 18 to be predominantly axial. The tab 76 can include lock a receiving aperture 78 to receive locking devices, which can be used to temporarily secure the lockout device 10 in the closed or locked position. The lock receiving aperture 78 can be an elongated hole formed through the tab 76 to receive the shackle of a padlock (not shown), for example. In some embodiments, the surface defining the lock receiving aperture 78 can have an inward taper extending from one side of the tab 76 toward the other, as shown in FIG. 4A. The inward taper can help locate the shackle of a padlock within the lock receiving aperture 78.

Additional guides 82, 84 can be formed in the arm 20 to further define and constrain the arm 20 within the outer housing 18. For example, one or more axially-extending linear ribs 82 can extend outwardly from the arm 20. The ribs 82 can be received within the slots 44 in the outer housing 18, which further guide motion of the outer housing 18 relative to the arm 20 in a predominantly axial direction. In some embodiments, the ribs 82 extend along both the engaging section 48 and the hook section 50 of the arm 20. As another example, a projection 84 can extend outwardly from a rear surface 86 of the arm 20. When assembled, the projection 84 can extend into and through a portion of the window 46 in the outer housing 18. When the projection 84 engages the outer perimeter of the window 46, further motion of the outer housing 18 relative to the arm 20 is prevented in the axial direction, to prevent the arm 20 from being withdrawn from the outer housing 18. As described, each of the guides formed in the outer housing 18 and arm 20 can have a male/female configuration. In some embodiments, each of the guides 76, 82, 84 formed in the arm 20 are male features, while each of the guides 42, 44, 46 formed in the outer housing 18 can be female features.

Figure 5:
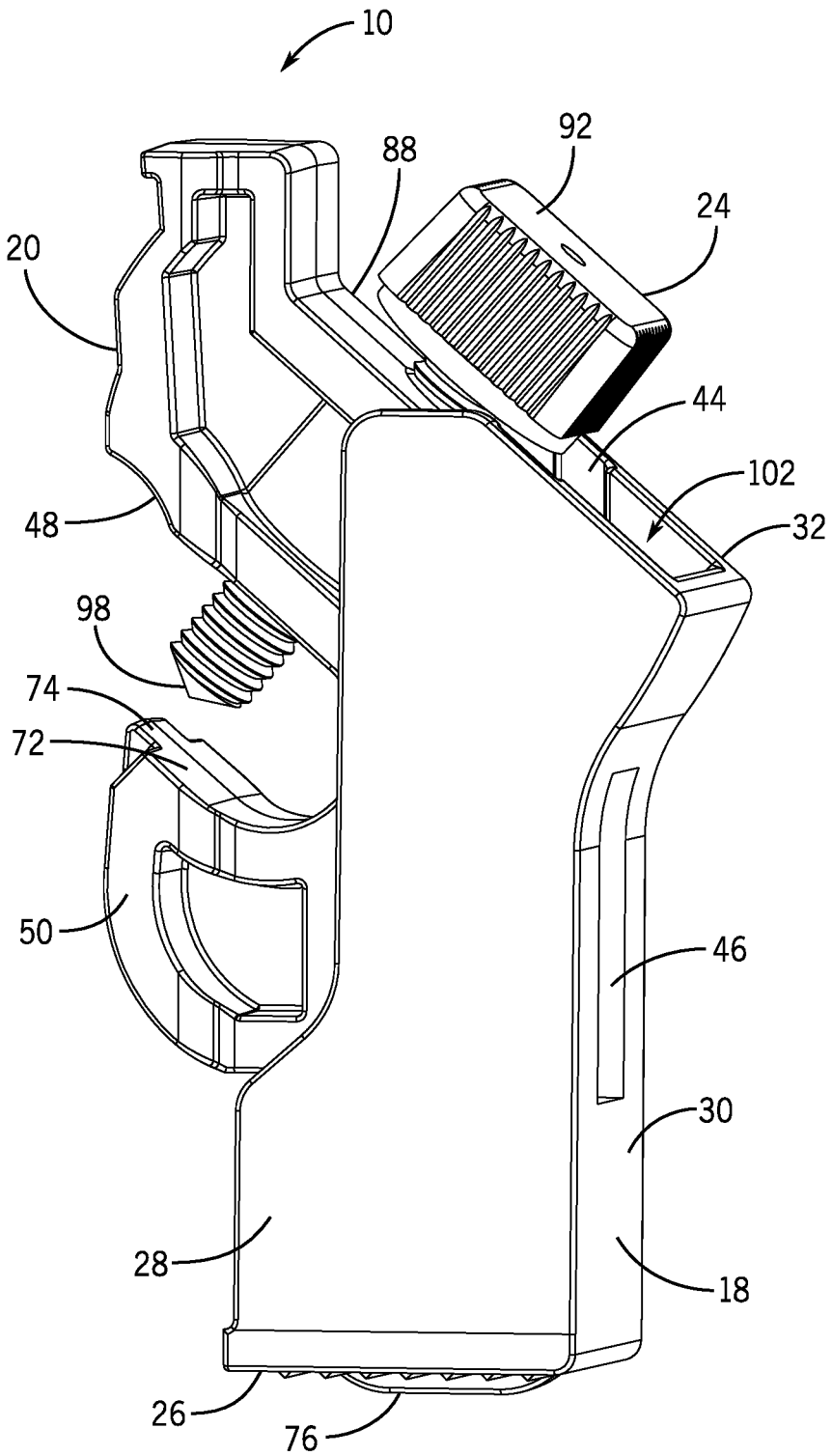
FIG. 5 is a perspective view of the circuit breaker lockout device shown in FIG. 1 in an "open" or "unlocked" configuration.

In some embodiments, an inclined surface 88 extends away from the rear surface 86 of the arm 20. A hole 90 can extend from the inclined surface 88 through the engaging section 48 of the arm 20 to the angled surface 52 to define a passageway for the fastener 24. In some embodiments, the hole 90 is threaded. The fastener 24 can be positioned within the hole 90 (as shown in FIG. 5), and can have a longitudinal axis X-X approximately (e.g., within about 5 degrees) perpendicular to the switch engaging surface 72 of the hook section 50. The inclined surface 88 can be a flat surface, and can receive a head 92 of the fastener 24. In some embodiments, the head 92 of the fastener 24 is generally square. The shape of the head 92 can constrain movement of the fastener 24 relative to the outer housing 18 and the arm 20 when the lockout device 10 is in a locked position, as described with reference to FIG. 6.

A groove 94 can extend axially upward through a portion of the hook section 50 to receive a portion of the biasing element 22 and the support structure 36. In some embodiments, the groove 94 has a semicircular shape that is adapted to form a clearance fit with the biasing element 22. The groove 94 can have a biasing surface 96 that can receive and engage the biasing element 22 to push the arm 20 away from the base wall 26 of the outer housing 18.

With the individual components described above and with additional reference to FIGS. 5 and 6, the function of the lockout device 10 is illustrated. In its resting, or open position shown in FIG. 5, the arm 20 is received within the cavity 34 of the outer housing 18. The tab 76 of the arm 20 extends through the channel 42 in the base wall 26 of the outer housing 18 (although only a portion of the tab 76 extends beyond the base wall 26), and the ribs 82 are received within the slots 44 formed in the side walls 28, 32 of the outer housing 18. The projection 84 extends into and engages the perimeter of the window 46 to prevent further removal of the arm 20 out of the cavity 34 of the outer housing 18, especially in the axial direction. The biasing element 22 is received around the support structure 36 of the outer housing 18 and within the groove 94, and contacts both the biasing surface 96 and the outer housing 18 to bias the arm 20 away from the base wall 26 of the outer housing 18. The fastener 24 and its head 92 extend out of the outer housing 18.

The lockout device 10 can be secured to a circuit breaker 12 by first locating and engaging the switch 14 of the circuit breaker 12 with the hook section 50 of the arm 20. Specifically, the switch engaging surface 72 of the hook section 50 can contact the switch 14, which extends into the switch receiving recess 68. The fastener 24 can be translated through the arm 20 along axis X-X toward the circuit breaker switch 14 (by threaded engagement with the opening 90), until the fastener 24 creates secured engagement between the switch engaging surface 72, the switch 14, and the fastener 24 in the engaging section 48. In some embodiments, the fastener has a cone tip 98 defining an acute angle. For example, the cone tip 98 can be defined by an angle of about approximately (e.g., within about 5 degrees) 30 degrees. The engaging section 48 contacts the body 16 of the circuit breaker 12 to prevent the arm 20 of the lockout device 10 from being moved significantly in any direction. Specifically, the engaging section 48 of the arm 20 prevents rotation of the circuit breaker switch 14, which can maintain the circuit breaker 12 in an open position to allow OSHA-compliant maintenance or service to equipment.

Once the lockout device 10 is properly secured to a circuit breaker 12, the lockout device 10 can be "locked" to prevent any unwanted tampering or movement of the device that could affect the lockout device's 10 ability to maintain the circuit breaker 12 in an open position. To lock the lockout device 10 as shown in FIG. 6, the outer housing 18 can be urged upward relative to the arm 26, against the bias of the biasing element 22. The guides formed between the outer housing 18 and the arm 20 constrain the motion of the outer housing 18 relative to the arm 20, and cause the outer housing 18 to translate axially. When the outer housing 18 translates, the tab 76 of the arm 10 extends further (relative to the open position shown in FIG. 5) through the channel 42 formed through the base wall 26 of the outer housing 18, exposing some or all of the lock receiving aperture 78 externally from the cavity 34. An operator can pass the shackle of a lock (not shown) through the lock receiving aperture 78. The biasing element 22 and guides together allow a user to translate the outer housing 18 axially relative to the arm 20 using one hand, which then allows the same user to pass a lock through the lock receiving aperture 78 with the other hand. Accordingly, the lockout device 10 can be coupled to and locked to a circuit breaker by a single operator. When the outer housing 18 is released, the lock extending through the lock receiving aperture 78 can prevent the biasing element 22 from returning the outer housing 18 to its open position relative to the arm 20. In the locked position, the support structure 36 may extend into the groove 94 of the arm 20. A bottom surface 100 of the hook section 50 can engage the base wall 26 to prevent additional movement between the outer housing 18 and the arm 20.

When the outer housing 18 is in the closed or locked position relative to the arm 20, the fastener 24 can be prevented from rotating by the outer housing 18, based on the shape of the fastener head 92 and the profile of the outer housing 18 that is slid around it. When the outer housing 18 moves upward into the closed position, the head 92 of the fastener 24 is received within an upper cavity 102 formed by the side walls 28, 30, 32. In some embodiments, each of the side walls 28, 30, 32 have an upper section 104, 106, 108 that flares upwardly and outwardly to define the upper cavity 102. The upper sections 104, 106, 108 of the side walls 28, 30, 32 form a clearance fit around the head 92 of the fastener 24, but prevent significant (i.e., more than a quarter turn) rotation of the head 92 due to the rectangular shape of the head 92 relative to the profile of the outer housing 18. In this position, rotation of the head 92 would cause the head 92 to contact one or more of the upper sections 104, 106, 108 of the side walls 28, 30, 32, which prevent any further rotation in that direction. By preventing unwanted rotation of the fastener 24 relative to the outer housing 18 and the arm 20, the fastener 24 and arm 20 remain engaged with the circuit breaker 12 at all times when the circuit breaker 12 is locked out.

Once the service or maintenance to the equipment associated with the circuit breaker 12 is completed, the lockout device 10 can be unlocked. To unlock the device, an operator can remove the lock from the lock receiving aperture 78 formed through the tab 76. The biasing element 22 then urges the outer housing 18 axially away from the arm 20 and the fastener 24, which causes the outer housing 18 to return to its initial, open position with the projection 84 of the arm 20 engaging the perimeter of the window 46 in the outer housing 18. The head 92 of the fastener 24 is once again exposed from the upper cavity 102, and can be readily manipulated using a wrench or the hand of an operator to loosen the fastener 24 from the circuit breaker switch 14. Once the fastener 24 has been loosened from the circuit breaker switch 14, compressive engagement between the hook section 50, the circuit breaker switch 14, and the fastener 24 is released, and the lockout device 10 can be removed. Like the locking process, the unlocking process of the lockout device 10 can be performed safely by a single user.

Using the lockout device 10 described herein, several different sizes and shapes of circuit breaker 12 can be secured and locked out in accordance with OSHA regulations. The lockout device 10 can be quickly coupled and uncoupled to a circuit breaker 12 by hand, and may not require any tools to operate, which can greatly improve efficiency and decrease necessary inventory within a warehouse or factory.

Within this specification embodiments have been described in a way which enables a clear and concise specification to be written, but it is intended and will be appreciated that embodiments may be variously combined or separated without parting from the invention. For example, it will be appreciated that all preferred features described herein are applicable to all aspects of the invention described herein.

Thus, while the invention has been described in connection with particular embodiments and examples, the invention is not necessarily so limited, and that numerous other embodiments, examples, uses, modifications and departures from the embodiments, examples and uses are intended to be encompassed by the claims attached hereto. The entire disclosure of each patent and publication cited herein is incorporated by reference, as if each such patent or publication were individually incorporated by reference herein.

Various features and advantages of the invention are set forth in the following claims.

We claim:

1. A lockout device for securing a circuit breaker switch, the lockout device comprising:

an outer housing having side walls extending away from a base wall formed on one axial end of the outer housing to define a cavity;

an arm received within a portion of the cavity, the arm having a hook section and an engaging section positioned apart from one another to receive the circuit breaker switch therein;

a spring positioned between the base wall and the arm, the spring biasing the outer housing axially relative to the arm; and a screw extending through the engaging section of the arm toward the hook section, the screw being movable between the engaging section and the hook section.

2. The lockout device of claim 1, further comprising a support structure extending upwardly from the base wall of the outer housing and into the spring.

3. The lockout device of claim 2, wherein a portion of the support structure and the spring are received within a groove formed in the arm.

4. The lockout device of claim 1, wherein the arm further comprises a tab formed on one end of the arm that extends into a channel formed through the base wall of the outer housing.

5. The lockout device of claim 4, wherein an elongated hole is formed through the tab to receive a lock therethrough.

6. The lockout device of claim 4, wherein the outer housing is moveable relative to the housing between an open position and a closed position, and wherein the tab extends through the channel in both the open and closed positions.

7. The lockout device of claim 6, wherein the tab extends through the channel axially further in the closed position than in the open position.

8. The lockout device of claim 1, wherein the screw has a rectangular head.

9. The lockout device of claim 8, wherein the rectangular head of the screw is selectively receivable within the outer housing, the side walls of the outer housing constraining rotational movement of the screw when the rectangular head of the screw is received within the outer housing.

10. The lockout device of claim 1, wherein the screw has a cone tip defined by an angle of approximately 30 degrees.

11. A lockout device for securing a circuit breaker switch, the lockout device comprising:

an outer housing having a base wall on one axial end thereof and side walls extending away from the base wall to collectively define a cavity, the base wall having a channel formed therethough;

an arm received within a portion of the cavity and having an engaging section and a hook section that define a switch receiving recess, the arm having a tab axially extending through the channel formed in the base wall; and a screw extending through the engaging section of the arm toward the hook section, the screw being threadably adjustable axially toward the hook section to engage the circuit breaker switch.

12. The lockout device of claim 11, wherein a biasing element is positioned within the cavity of the outer housing to bias the outer housing relative to the arm.

13. The lockout device of claim 12, wherein a support structure extends upwardly from the base through a portion of the biasing element to secure the biasing element within the outer housing.

14. The lockout device of claim 13, wherein a groove is formed in a portion of the arm to receive the biasing element and the support structure therein.

15. The lockout device of claim 12, wherein the outer housing is movable relative to the arm, against the bias of the biasing element, between an open position and a closed position, the tab extending through the channel axially further in the closed position than in the open position.

16. The lockout device of claim 15, wherein in the closed position, a circular hole formed through the tab is fully exposed outside the cavity of the outer housing to receive a lock therethrough.

17. The lockout device of claim 11, wherein the hook section is partially defined by a planar switch engaging surface extending approximately perpendicular to a longitudinal axis of the screw.

18. The lockout device of claim 11, wherein a guide is formed between the arm and the side walls of the outer housing.

19. The lockout device of claim 18, wherein the guide comprises a window formed through one side wall and a projection extending outwardly from the arm, the projection being received within the window to constrain motion of the outer housing relative to the arm.

20. The lockout device of claim 18, wherein the guide comprises a slot formed in one side wall and a rib extending outwardly from the arm, the rib being received within the slot to constrain motion of the housing relative to the arm.

* * * * *